United States Patent [19]

Norman et al.

[11] 4,416,661

[45] Nov. 22, 1983

[54] INJECTION SITE FOR FLUIDS

[75] Inventors: Melvin H. Norman, Oakland; Reinhold R. Manske, Hayward; Neil J. Sheehan, Berkeley, all of Calif.

[73] Assignee: Cutter Laboratories, Inc., Berkeley, Calif.

[21] Appl. No.: 334,277

[22] Filed: Dec. 24, 1981

[51] Int. Cl.[3] ..... A61M 5/00

[52] U.S. Cl. ..... 604/86; 215/247; 215/275

[58] Field of Search ..... 215/247, 274–275, 215/DIG. 3; 604/86, 201, 415

[56] References Cited

U.S. PATENT DOCUMENTS

| | | | |
|---|---|---|---|
| 1,803,316 | 5/1931 | Brown | 604/415 |
| 2,794,437 | 6/1957 | Tash | 604/415 |
| 3,900,028 | 8/1975 | McPhee | 215/247 |
| 4,187,149 | 2/1980 | Tolbert et al. | 215/247 X |
| 4,219,912 | 9/1980 | Adams | 604/86 |
| 4,289,129 | 9/1981 | Turner | 604/86 |
| 4,294,249 | 10/1981 | Sheehan et al. | 604/86 |

*Primary Examiner*—Dalton L. Truluck
*Attorney, Agent, or Firm*—James A. Giblin

[57] ABSTRACT

Injection site device comprising an elastomeric plug closing a fluid entry port and held in a compression fit by means of an open overcap bonded to the outer surfaces of the entry port.

8 Claims, 7 Drawing Figures

INJECTION SITE FOR FLUIDS

BACKGROUND OF THE INVENTION

1. Field

This disclosure is concerned generally with resealable fluid entry devices and specifically with an improved entry port for the introduction of fluids into parenteral fluid administration equipment.

2. Prior Art

Various re-sealable devices are known for introducing solutions of pharmaceuticals into containers or administration sets for other pharmaceutical solutions. Typical of these are those shown in U.S. Pat. Nos. 3,332,418; 3,990,445; 4,048,995; 4,048,996; 4,076,023; 4,219,912; 4,279,352; and 4,294,249. Injection sites of the type shown in U.S. Pat. No. 3,776,229 are commonly used on a volumetric measuring chamber which forms an essential part of some parenteral fluid administration sets. The injection site devices of U.S. Pat. Nos. 3,900,028 and 4,207,988 are often found useful with parenteral solution containers.

In the manufacture of injection site devices, it is important that the design of the device provides for a relatively simple and inexpensive manufacture. Although the prior art devices have met these goals with varying degrees of success, we have now found that injection site devices can be made in a very simple, reliable, and economical manner which, quite surprisingly, has not been previously recognized by those skilled in this field. Details of our invention are disclosed below and in the Figures.

SUMMARY OF THE INVENTION

Our injection site device comprises the combination of a generally tubular port which is sealed at its inlet by an elastomeric injection port plug held in place via a compression fit by an overcap. The overcap has a central aperture which permits the target portion of the injection port plug to present itself, thereby providing access (e.g. via a needle or cannula) beyond the plug. Inner portions of the overcap are bonded (sealed) to the outer surface of the tubular port thereby providing a tamperproof injection site. In preferred embodiments the tubular port and the overcap comprise well known polymeric materials such as acrylonitrile-butadiene-styrene (ABS), acrylonitrile-styrene copolymer (SAN) or polypropylene which can be welded ultrasonically. Alternatively the bonding may be via solvent bonds using materials such as ABS, SAN and the like. In the case of ultrasonic welding, bonding is facilitated by incorporating on the inner surfaces of the overcap relatively small spaced projections which provide edges for spaced welding sites. In the case of solvent bonding, such projections, if used, would preferably avoid the use of peaked edges and, instead, provide a greater surface area contact with the outer surface of the tubular port. Preferably, at least a portion of the elastomeric plug projects through the aperture of the overcap and that portion is substantially flat to facilitate swabbing prior to use. In the device of this invention, the overcap axially compresses a generally circular flange or ledge extending from the body of the plug against the end of the entry port, thereby providing an effective fluid-tight seal between the exterior of the overcap and the interior of the entry port.

SPECIFIC EMBODIMENTS

The injection site device of this invention can be fabricated from a variety of materials known to those skilled in the art. These materials should be of a type acceptable for medical applications. The device is generally tubular and comprises three distinct portions: an entry port, an elastomeric or rubber-like entry port plug, and an overcap which holds the plug in place via a compression fit while still providing access to the plug via an aperture over the central part of the plug. Since the plug itself should be re-sealable, it should be made of a medical grade elastomeric material or a like resealable material. The overcap which holds the plug in place and the entry port may be made from a variety of polymeric materials such as ABS, SAN, polypropylene or the like. Preferably, the overcap and entry port comprise similar materials which can be bonded together via ultrasonic techniques or solvent bonding to assure a tamper-proof device. In our best devices made to date, the overcap and entry port are both made of ABS and ultrasonically welded. Details of these devices and how they are made are described below.

Figure 1:
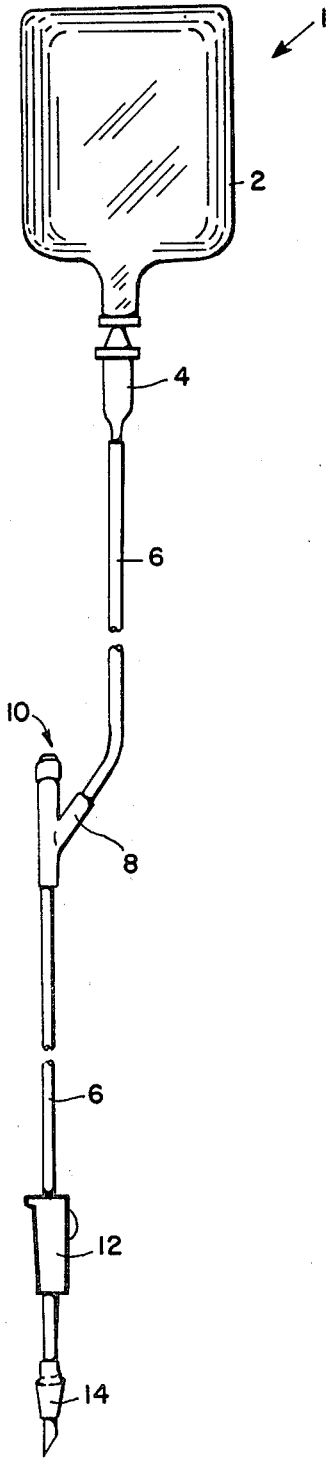
FIG. 1 illustrates a typical application of the injection site in the form of a "Y" site in a parenteral fluid administration system.

As can be seen from FIG. 1, the injection site device 10 of this invention can be used for access to an intravenous administration set where it is commonly known as a "Y" injection site. In FIG. 1, the injection Y site is shown as a connecting part of I.V. tubing 6, typically made of a PVC material, which connects a parenteral solution container 2 and a needle assembly 14 (only partially shown). The overall system 1 of FIG. 1 typically includes a drip chamber 4 and a roller clamp 12 which regulates the flow of fluid from bottle 2 through port 8 and needle assembly 14.

Figure 2:
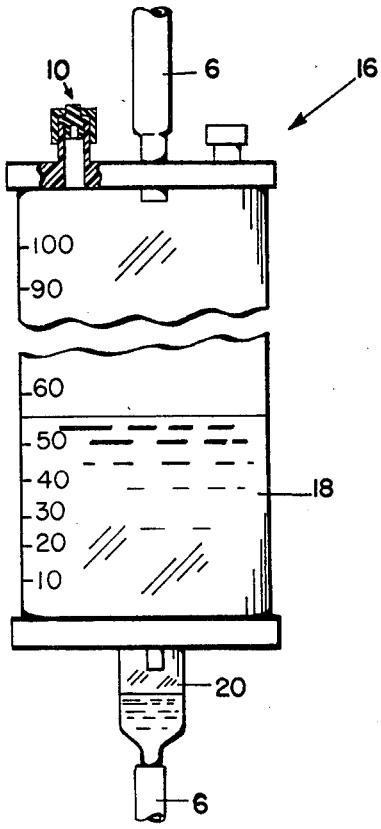
FIG. 2 illustrates the injection site device in a volumetric container for parenteral fluid administration sets.

FIG. 2 illustrates the injection site 10 as part of a volumetric device 16 of a type used to administer a carefully controlled volume of fluid 18 through a drip chamber 20 to a patient via tubing 6. The upper portion of tubing 6, as shown in FIG. 2, is, of course, connected to a container such as 2 in FIG. 1.

Figure 3:
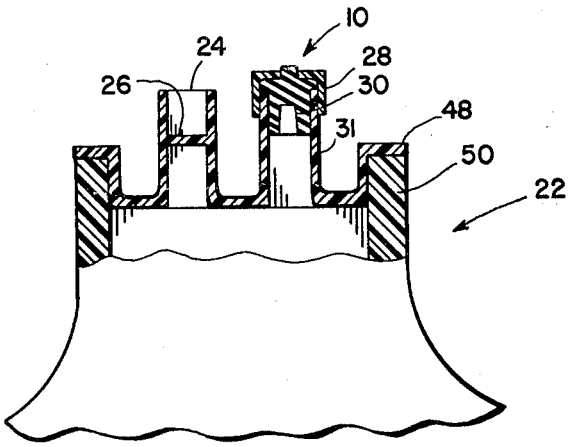
FIG. 3 illustrates the device as part of the closure of a simple parenteral fluid container.

FIG. 3 illustrates the injection site device 10 as part of the closure system for a container 22 (only the top portion is shown) which, in this example, has a neck portion 50 into which is sealed a closure portion 48 having two means of access to the interior of the container 22, a primary entry port 24 sealed by membrane 26 and a secondary injection site port 28 and entry port 31 showing in cross section the injection site device 10 of this invention.

Figure 4:
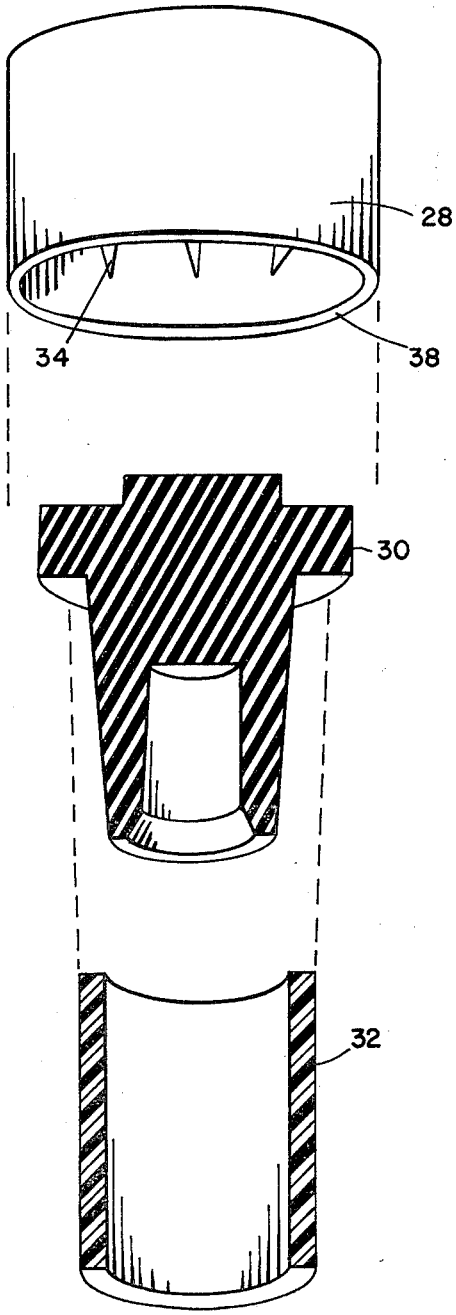
FIG. 4 illustrates an exploded view in partial cross section of one embodiment of the device of this disclosure.
Figure 5:
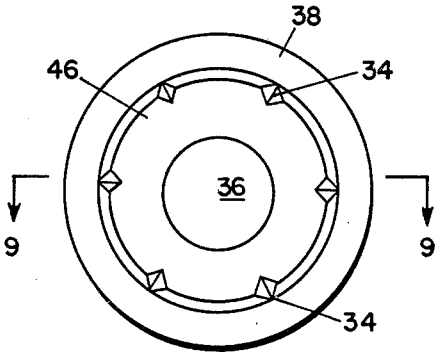
FIGS. 5, 6, and 7 illustrate in detail the individual components of FIG. 4.
Figure 6:
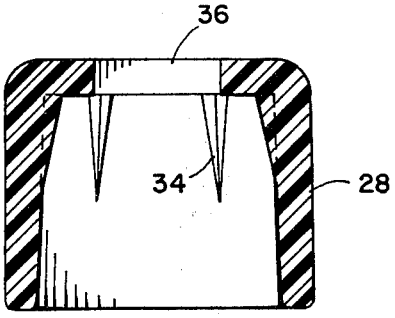

FIG. 4 illustrates in partial cross section an enlarged and exploded view of device 10 shown generally in FIGS. 1, 2 and 3. As can be seen, the device of FIG. 4 comprises three main components: the generally circular overcap 28, a re-sealable rubber-like (elastomeric) plug 30, and an entry (injection) port 32. FIG. 5 illustrates a bottom view of overcap 28 showing bottom rim 38, bottom surface 46 of the top portion of the overcap, and aperture 36 disposed in a central part of the top portion of the overcap. Also shown in FIG. 5 is a series of spaced longitudinal edge projections 34 from the inner wall of the overcap 28. These surface projections 34 are also partially shown in FIG. 4 and in FIG. 6 which is a cross-section of FIG. 5 taken at lines 9—9. In preferred embodiments the longitudinal projections 34 extend from the bottom surface 46 of the overcap top to a point about two-thirds the distance to the overcap bottom rim 38 and, to facilitate insertion onto the entry port 32, the projections are generally tapered from the top to the lowest portion where they merge into the lower part of the overcap. Ultrasonic welding of the cap 28 to the outer wall of the port 32 is facilitated by having on projections 34 relatively sharp edges for contact with the outer wall of the port 32. In one specific example in an overcap measuring about 0.25 inches in largest inner diameter, and about 0.25 inches in height, the tapered projections were about 0.15 inches long and, at their highest points (near the bottom surface of the overcap top) about 0.025 inches in elevation. The longitudinal projections 34 assist in forming a tamperproof bond (44 in FIG. 7) between the overcap 28 and the outer surface of the entry port 32.

Figure 7:
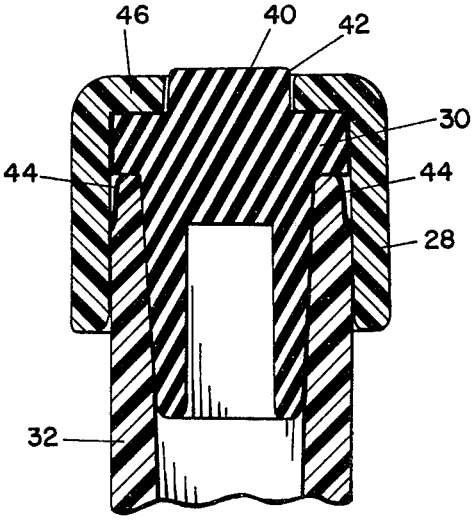

As can be seen in FIG. 7, when the elastomeric plug 30 is in place in the entry port 32 and the overcap 28 bonded or sealed in place in a downwardly position, the plug is held in place via a compression fit at the end of entry port 32 and a top portion projects through the circular aperture (in our example, about 0.135 to 0.140 inches in diameter) (36 in FIG. 5) to provide a substantially flat surface 40 which is easily swabable prior to use. In a preferred embodiment, the elastomeric plug 30 easily slips into entry port 32 (to avoid the need for lubrication) and includes a centrally located bore within a portion of the plug 30 which extends into the entry port 32. This extended portion acts as a guide for the needle.

To assure a tamperproof, hermetic seal of the plug 30 in the entry port 32, the overcap 28 and outer surface of the entry port 32, the overcap 28 should be bonded to the entry port 32. As mentioned, this bonding can be accomplished in a variety of ways such as via solvent bonding or, more preferably, via ultrasonic welding techniques. One preferred method of bonding ABS materials involves ultrasonically welding the overcap 28 via the longitudinal projections 34 to the entry port 32 outer surface by placing the assembly under an ultrasonic horn vibrating at about 20 KH for a fraction (e.g. 1/10th) of a second at slight pressure (e.g. about 5 psi). Other methods of bonding will be apparent given this disclosure. In some applications, especially to assure that the ultrasonic welding forces are directed primarily to the projections 34, it may be desirable to have a slight annular recess (e.g. about 0.20 inches in diameter and about 0.010 inches deep) at the top of the overcap and surrounding the central aperature. In that type of design, the contact with the ultrasonic horn is directed to the periphery of the overcap top and unnecessary contact with the central portion of the overcap and the projecting top (target site) of the elastomeric plug is avoided.

It should be understood that the examples shown in the figures and described above are for illustrative purposes only and that the scope of this invention should be limited only by the following claims.

We claim:

1. An injection site device for a parenteral fluid administration system, comprising a generally tubular injection port having an outlet, an inlet end and a bore; an elastomeric plug, a portion of which extends within the bore of the inlet conforming generally to the bore, the plug having an annular outwardly extending flange which generally covers the end of the inlet; and a cap member having a top portion having a central aperture and a skirt portion having an inner wall fitting around and generally conforming to a portion of the outer wall of the port inlet, the cap skirt including a plurality of longitudinal projections beginning at about the top portion of the inner wall of the skirt and tapering in a downwardly direction, the cap member compressingly engaging the flange of the plug by means of a bond between at least a portion of the longitudinal projections on inner wall of the skirt of the cap and the outer wall of the port, the engagement resulting in projection of at least a portion of the top of the plug through the aperture of the cap member.

2. The injection site device of claim 1 wherein the tapered projections are substantially parallel to each other and terminate at their lower ends at points intermediate the top and bottom of the inner skirt wall.

3. The injection site of claim 1 wherein the portion of the plug projecting through the cap aperture is substantially flat.

4. The injection site of claim 1 wherein the portion of the plug which extends within the bore of the port includes a centrally located bore.

5. The injection site of claim 1 wherein the injection port is a branch of an injection-Y device.

6. The injection site of claim 1 wherein the injection port is in communication with and part of a volumetric measuring chamber for intravenous fluids.

7. The injection site of claim 1 wherein the injection port is in communication with and part of a container for parenteral fluids.

8. The injection site of claim 1 where the top portion of the cap member includes an annular recessed portion surrounding the aperture.

* * * * *